US011259139B1

(12) United States Patent
Carlile et al.

(10) Patent No.: US 11,259,139 B1
(45) Date of Patent: Feb. 22, 2022

(54) EAR-MOUNTABLE LISTENING DEVICE HAVING A RING-SHAPED MICROPHONE ARRAY FOR BEAMFORMING

(71) Applicant: Iyo Inc., Redwood City, CA (US)

(72) Inventors: Simon Carlile, San Francisco, CA (US); Jason Rugolo, Mountain View, CA (US); William Woods, Mountain View, CA (US); Takahiro Unno, San Francisco, CA (US)

(73) Assignee: Iyo Inc., Redwood City, CA (US)

( * ) Notice: Subject to any disclaimer, the term of this patent is extended or adjusted under 35 U.S.C. 154(b) by 0 days.

(21) Appl. No.: 17/157,434

(22) Filed: Jan. 25, 2021

(51) Int. Cl.

| | |
|---|---|
| ***H04R 5/02*** | (2006.01) |
| ***H04S 7/00*** | (2006.01) |
| ***H04R 1/40*** | (2006.01) |
| ***H04R 1/10*** | (2006.01) |

(52) U.S. Cl.
CPC ..... *H04S 7/304* (2013.01); *H04R 1/1041* (2013.01); *H04R 1/406* (2013.01)

(58) Field of Classification Search
CPC ..... H04S 7/304; H04R 1/1041; H04R 1/406
See application file for complete search history.

(56) References Cited

U.S. PATENT DOCUMENTS

| | | | | |
|---|---|---|---|---|
| 6,068,589 | A | 5/2000 | Neukermans | |
| 8,204,263 | B2 | 6/2012 | Pedersen et al. | |
| 8,630,431 | B2 | 1/2014 | Gran | |
| 9,510,112 | B2 | 11/2016 | Petersen et al. | |
| 10,142,745 | B2 | 11/2018 | Petersen et al. | |
| 2002/0001389 | A1 | 1/2002 | Amiri et al. | |
| 2006/0067548 | A1 | 3/2006 | Slaney et al. | |
| 2011/0137209 | A1 | 6/2011 | Lahiji et al. | |
| 2014/0119553 | A1 | 5/2014 | Usher et al. | |
| 2018/0146306 | A1* | 5/2018 | Benattar | H04W 4/80 |
| 2018/0197527 | A1 | 7/2018 | Guiu et al. | |
| 2019/0028803 | A1* | 1/2019 | Benattar | H04R 1/406 |
| 2019/0139563 | A1* | 5/2019 | Chen | G06N 3/0445 |
| 2020/0213711 | A1 | 7/2020 | Rugolo et al. | |
| 2020/0296492 | A1* | 9/2020 | McElveen | H04R 1/02 |

FOREIGN PATENT DOCUMENTS

| | | | |
|---|---|---|---|
| EP | 3062528 | A1 | 8/2016 |
| GB | 2364121 | A | 1/2002 |
| WO | 2012018641 | A2 | 2/2012 |

* cited by examiner

*Primary Examiner* — Simon King
(74) *Attorney, Agent, or Firm* — Nicholson De Vos Webster & Elliott LLP

(57) ABSTRACT

An ear-mountable listening device includes an adaptive phased array of microphones, a speaker, and electronics. The microphones are physically arranged into a ring pattern to capture sounds emanating from an environment. Each of the microphones is configured to output one of a plurality of first audio signals that is representative of the sounds captured by a respective one of the microphones. The speaker is arranged to emit audio into an ear. The electronics are coupled to the adaptive phased array and the speaker and include logic that when executed causes the ear-mountable listening device receive a user input identifying a first sound for cancelling or amplifying, steer a null or a lobe of the adaptive phased array based upon the user input, and generate a second audio signal that drives the speaker based upon a combination of one or more of the first audio signals.

21 Claims, 9 Drawing Sheets

EAR-MOUNTABLE LISTENING DEVICE HAVING A RING-SHAPED MICROPHONE ARRAY FOR BEAMFORMING

TECHNICAL FIELD

This disclosure relates generally to ear mountable listening devices.

BACKGROUND INFORMATION

Ear mounted listening devices include headphones, which are a pair of loudspeakers worn on or around a user's ears. Circumaural headphones use a band on the top of the user's head to hold the speakers in place over or in the user's ears. Another type of ear mounted listening device is known as earbuds or earpieces and include individual monolithic units that plug into the user's ear canal.

Both headphones and ear buds are becoming more common with increased use of personal electronic devices. For example, people use headphones to connect to their phones to play music, listen to podcasts, place/receive phone calls, or otherwise. However, headphone devices are currently not designed for all-day wearing since their presence blocks outside noises from entering the ear canal without accommodations to hear the external world when the user so desires. Thus, the user is required to remove the devices to hear conversations, safely cross streets, etc.

Hearing aids for people who experience hearing loss are another example of an ear mountable listening device. These devices are commonly used to amplify environmental sounds. While these devices are typically worn all day, they often fail to accurately reproduce environmental cues, thus making it difficult for wearers to localize reproduced sounds. As such, hearing aids also have certain drawbacks when worn all day in a variety of environments. Furthermore, conventional hearing aid designs are fixed devices intended to amplify whatever sounds emanate from directly in front of the user. However, an auditory scene surrounding the user may be more complex and the user's listening desires may not be as simple as merely amplifying sounds emanating directly in front of the user.

With any of the above ear mountable listening devices, monolithic implementations are common. These monolithic designs are not easily custom tailored to the end user, and if damaged, require the entire device to be replaced at greater expense. Accordingly, a dynamic and multiuse ear mountable listening device capable of providing all day comfort in a variety of auditory scenes is desirable.

BRIEF DESCRIPTION OF THE DRAWINGS

Non-limiting and non-exhaustive embodiments of the invention are described with reference to the following figures, wherein like reference numerals refer to like parts throughout the various views unless otherwise specified. Not all instances of an element are necessarily labeled so as not to clutter the drawings where appropriate. The drawings are not necessarily to scale, emphasis instead being placed upon illustrating the principles being described.

DETAILED DESCRIPTION

Embodiments of a system, apparatus, and method of operation for an ear-mountable listening device having a microphone array capable of performing acoustical beamforming are described herein. In the following description numerous specific details are set forth to provide a thorough understanding of the embodiments. One skilled in the relevant art will recognize, however, that the techniques described herein can be practiced without one or more of the specific details, or with other methods, components, materials, etc. In other instances, well-known structures, materials, or operations are not shown or described in detail to avoid obscuring certain aspects.

Reference throughout this specification to "one embodiment" or "an embodiment" means that a particular feature, structure, or characteristic described in connection with the embodiment is included in at least one embodiment of the present invention. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

Figure 1A:
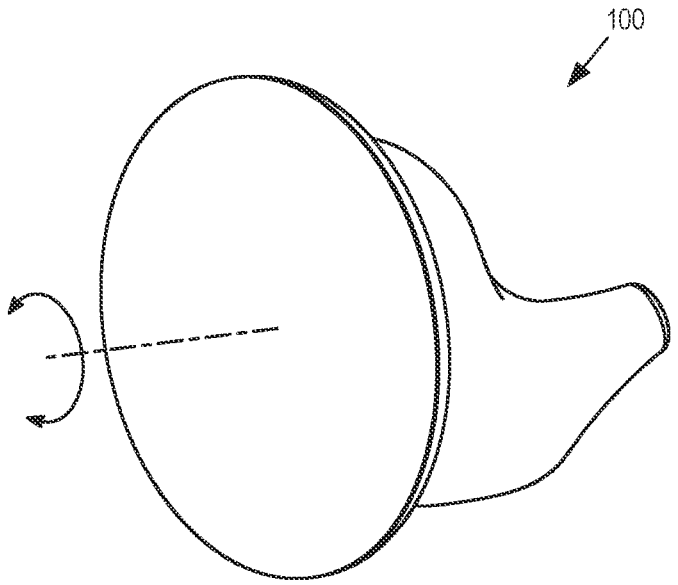
FIG. 1A is a front perspective illustration of an ear-mountable listening device, in accordance with an embodiment of the disclosure.
Figure 1B:
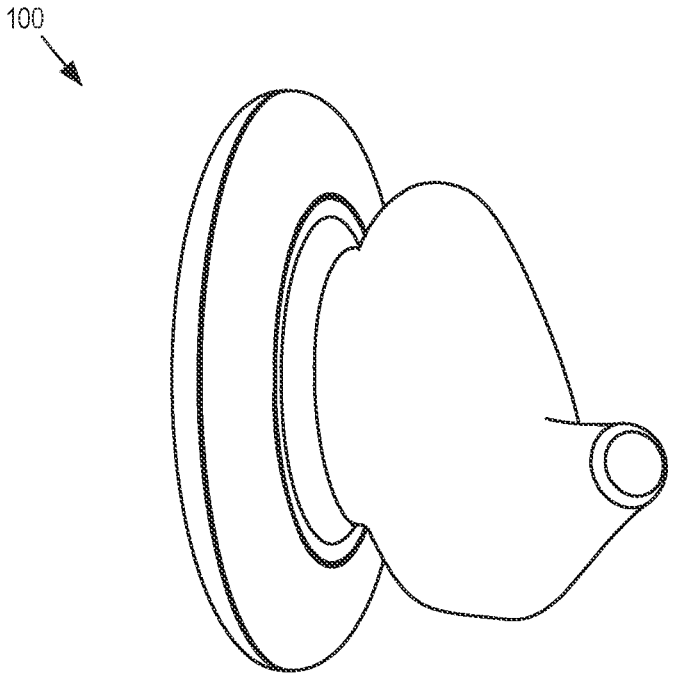
FIG. 1B is a rear perspective illustration of the ear-mountable listening device, in accordance with an embodiment of the disclosure.
Figure 1C:
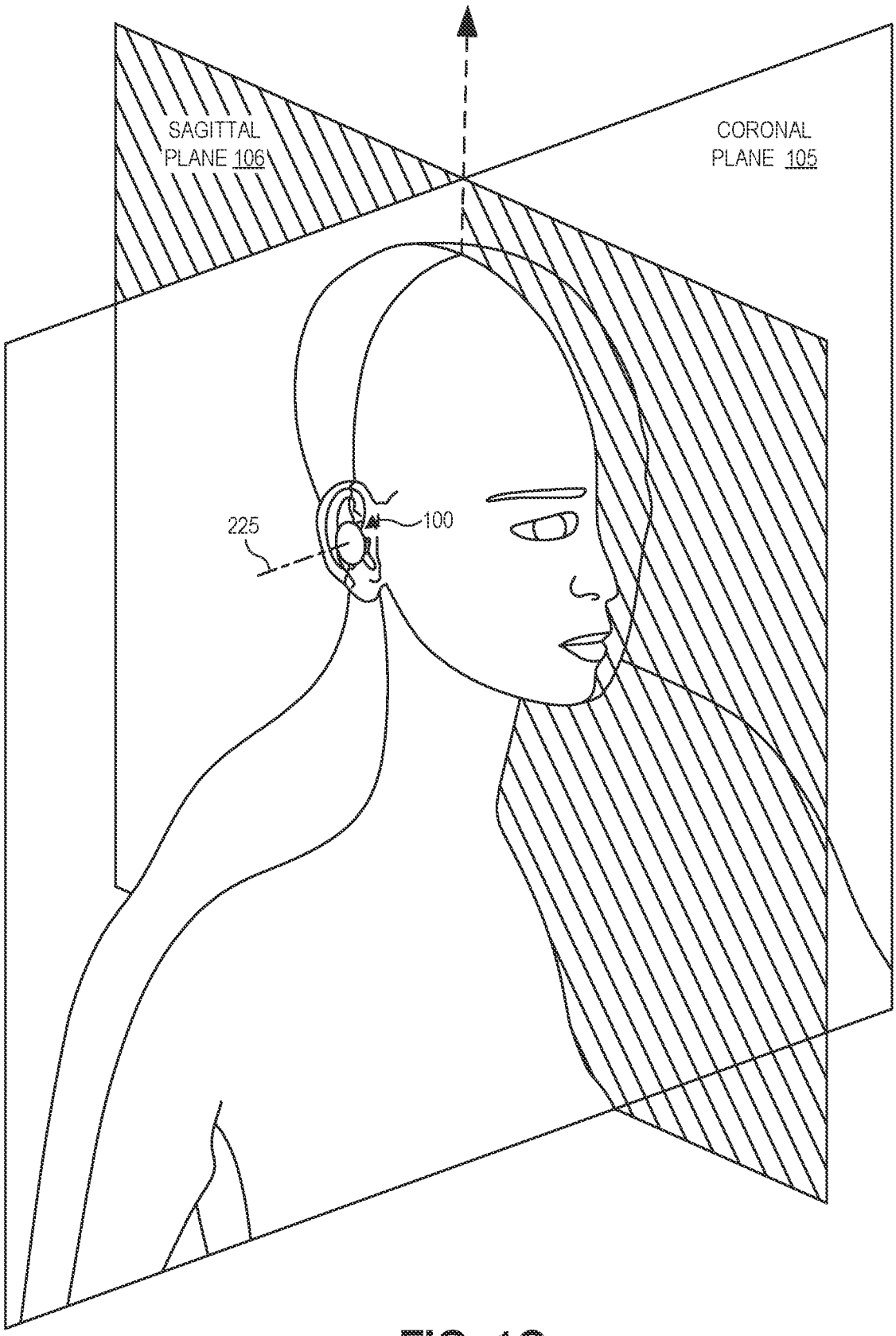
FIG. 1C illustrates the ear-mountable listening device when worn plugged into an ear canal, in accordance with an embodiment of the disclosure.

FIGS. 1A-C illustrate an ear-mountable listening device 100, in accordance with an embodiment of the disclosure. In various embodiments, ear-mountable listening device 100 (also referred to herein as an "ear device") is capable of facilitating a variety auditory functions including wirelessly connecting to (and/or switching between) a number of audio sources (e.g., Bluetooth connections to personal computing devices, etc.) to provide in-ear audio to the user, controlling the volume of the real world (e.g., modulated noise cancellation and transparency), providing speech hearing enhancements, localizing environmental sounds for spatially selective cancellation and/or amplification, and even rendering auditory virtual objects (e.g., auditory assistant or other data sources as speech or auditory icons). Ear-mountable listening device 100 is amenable to all day wearing. When the user desires to block out external environmental sounds, the mechanical design and form factor along with active noise cancellation can provide substantial external noise dampening (e.g., 40 to 50 dB). When the user desires a natural auditory interaction with their environment, ear-mountable listening device 100 can provide near (or perfect) perceptual transparency by reassertion of the user's natural Head Related Transfer Function (HRTF), thus maintaining spaciousness of sound and the ability to localize sound origination in the environment. When the user desires auditory aid or augmentation, ear-mountable listening device 100 may be capable of acoustical beamforming to dampen or nullify deleterious sounds while enhancing others. The auditory enhancement may be spatially aware and capable of amplitude and/or spectral enhancements to facilitate specific user functions (e.g., enhance a specific voice frequency originating from a specific direction while dampening other background noises). In some embodiments, machine learning principles may even be applied to sound segregation and signal reinforcement.

Figure 1D:
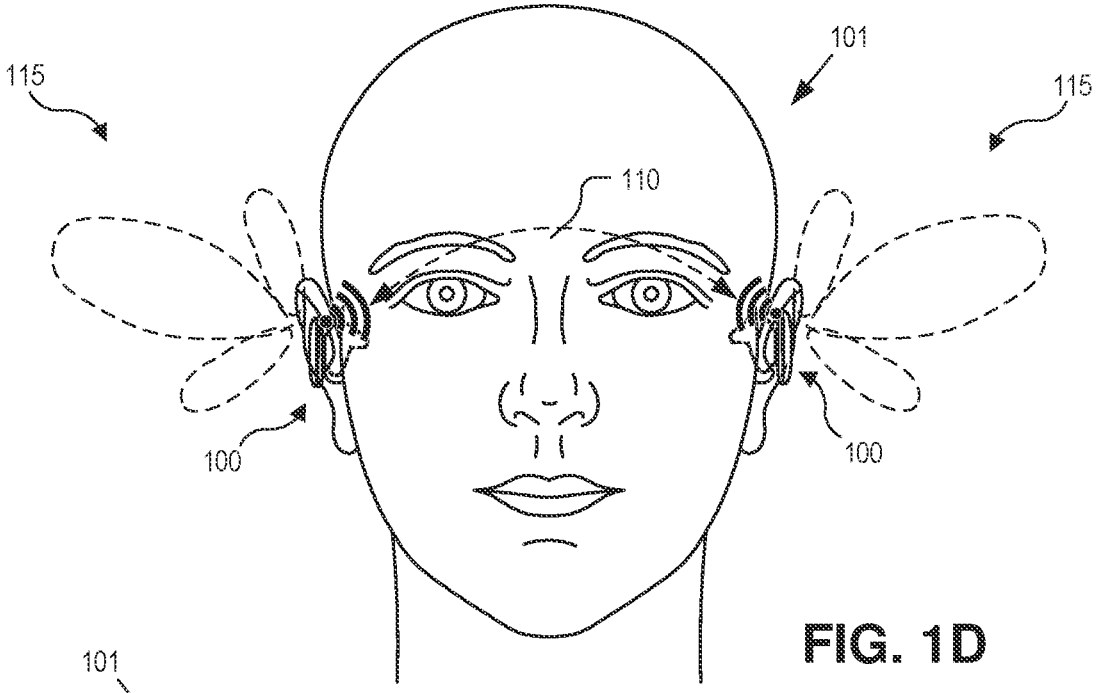
FIG. 1D illustrates a binaural listening system where the adaptive phased arrays of each ear-mountable listening device are linked via a wireless communication channel, in accordance with an embodiment of the disclosure.
Figure 1E:
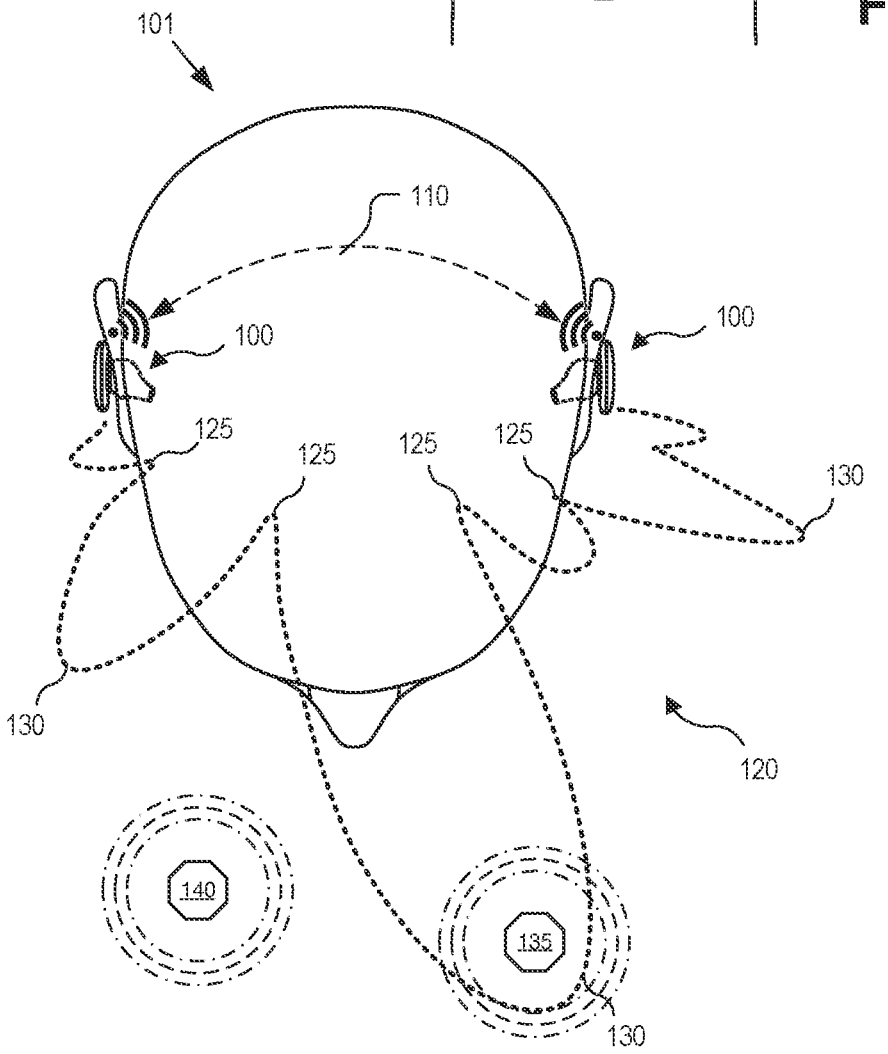
FIG. 1E illustrates acoustical beamforming to selectively steer nulls or lobes of the linked adaptive phased array, in accordance with an embodiment of the disclosure.

FIGS. 1D and 1E illustrate how a pair of ear-mountable listening devices 100 can be linked via a wireless communication channel 110 to form a binaural listening system 101. The adaptive phased array or microphone array of each ear device 100 can be operated separately with its own distinct acoustical gain pattern 115 or linked to form a linked adaptive phased array generating a linked acoustical gain pattern 120. Binaural listening system 101 operating as a linked adaptive phased array provides greater physical separation between the microphones than the microphones within each ear-mountable listening device 100 alone. This greater physical separation facilitates improved acoustical beamforming down to lower frequencies than is capable with a single ear device 100. In one embodiment, the inter-ear separation enables beamforming at the fundamental frequency (f0) of a human voice. For example, an adult male human has a fundamental frequency ranging between 100-120 Hz, while f0 of an adult female human voice is typically one octave higher, and children have a f0 around 300 Hz. Embodiments described herein provide sufficient physical separation between the microphone arrays of binaural listening system 101 to localize sounds in an environment having an f0 as low as that of an adult male human voice, as well as, adult female and children voices, when the adaptive phased arrays are linked across paired ear devices 100.

FIG. 1E further illustrates how the microphone arrays of each ear device 100, either individually or when linked, operate as adaptive phased arrays capable of selective spatial filtering of sounds in real-time or on-demand in response to a user command. The spatial filtering is achieved via acoustical beamforming that steers either a null 125 or a lobe 130 of acoustical gain pattern 120. If a lobe 130 is steered in the direction of a unique source 135 of sound, then unique source 135 is amplified or otherwise raised relative to the background noise level. On the other hand, if a null 125 is steered towards a unique source 140 of sound, then unique source 140 is cancelled or otherwise attenuated relative to the background noise level.

The steering of nulls 125 and/or lobes 135 is achieved by adaptive adjustments to the weights (e.g., gain or amplitude) or phase delays applied to the audio signals output from each microphone in the microphone arrays. The phased array is adaptive because these weights or phase delays are not fixed, but rather dynamically adjusted, either automatically due to implicit user inputs or on-demand in response to explicit user inputs. Acoustical gain pattern 120 itself may be adjusted to have a variable number and shape of nulls 125 and lobes 130 via appropriate adjustment to the weights and phase delays. This enables binaural listening system 101 to cancel and/or amplify a variable number of unique sources 135, 140 in a variable number of different orientations relative to the user. For example, the binaural listening system 101 may be adapted to attenuate unique source 140 directly in front of the user while amplifying or passing a unique source positioned behind or lateral to the user.

Figure 2:
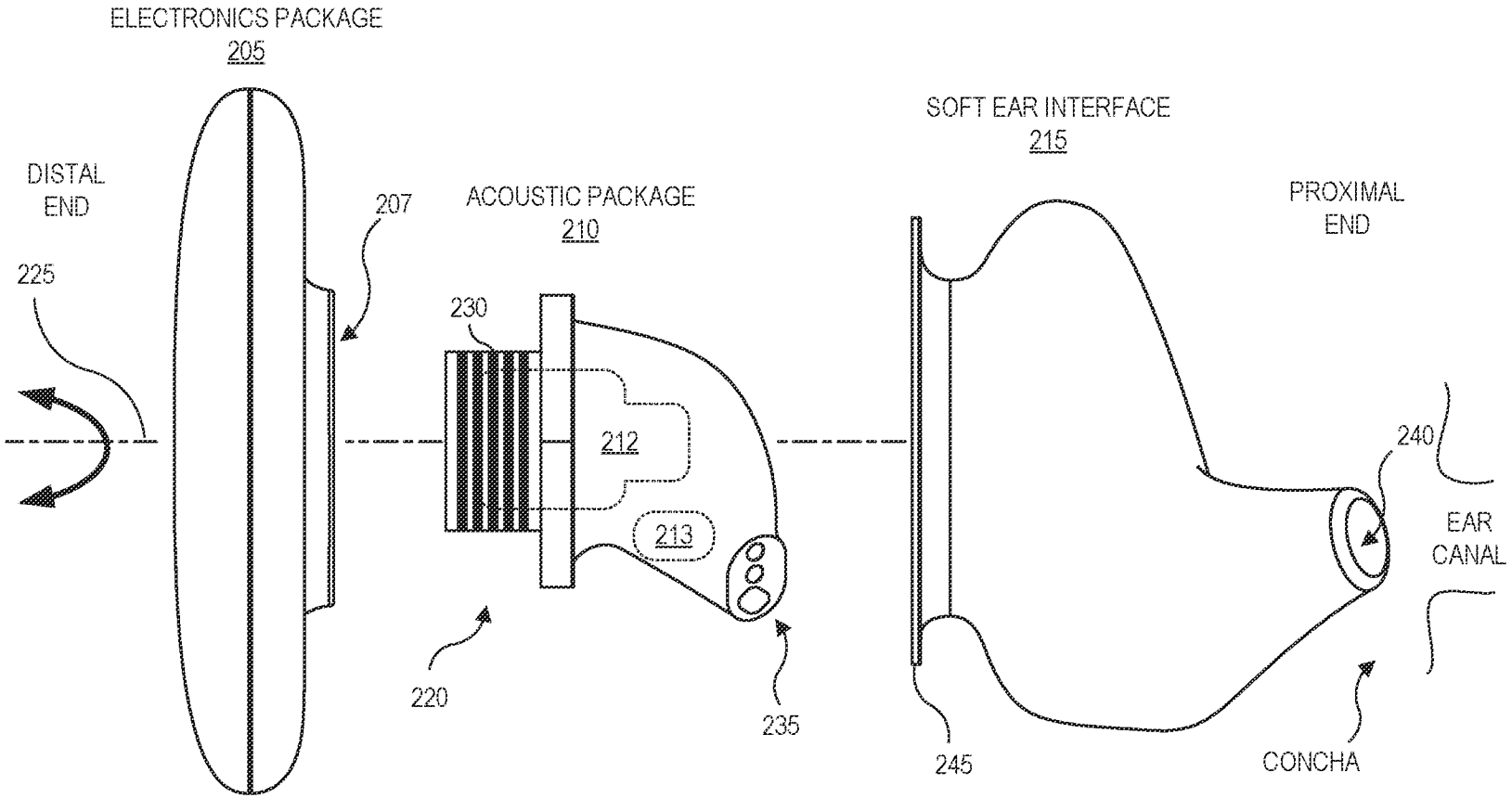
FIG. 2 is an exploded view illustration of the ear-mountable listening device, in accordance with an embodiment of the disclosure.

Referring to FIG. 2, ear-mountable listening device 100 has a modular design including an electronics package 205, an acoustic package 210, and a soft ear interface 215. The three components are separable by the end-user allowing for any one of the components to be individually replaced should it be lost or damaged. The illustrated embodiment of electronics package 205 has a puck-like shape and includes an array of microphones for capturing external environmental sounds along with electronics disposed on a main circuit board for data processing, signal manipulation, communications, user interfaces, and sensing. In some embodiments, the main circuit board has an annular disk shape with a central hole to provide a compact, thin, or close-into-the-ear form factor.

The illustrated embodiment of acoustic package 210 includes one or more speakers 212, and in some embodiments, an internal microphone 213 for capturing user noises incident via the ear canal, along with electromechanical components of a rotary user interface. A distal end of acoustic package 210 may include a cylindrical post 220 that slides into and couples with a cylindrical port 207 on the proximal side of electronics package 205. In embodiments where the main circuit board within electronics package 205 is an annular disk, cylindrical port 207 aligns with the central hole (e.g., see FIG. 6B). The annular shape of the main circuit board and cylindrical port 207 facilitate a compact stacking of speaker(s) 212 with the microphone array within electronics package 205 directly in front of the opening to the ear canal enabling a more direct orientation of speaker 212 to the axis of the auditory canal. Internal microphone 213 may be disposed within acoustic package 210 and electrically coupled to the electronics within electronics package 205 for audio processing (illustrated), or disposed within electronics package 205 with a sound pipe plumbed through cylindrical post 220 and extending to one of the ports 235 (not illustrated). Internal microphone 213 may be shielded and oriented to focus on user sounds originating via the ear canal. Additionally, internal microphone 213 may also be part of an audio feedback control loop for driving cancellation of the ear occlusion effect.

Post 220 may be held mechanically and/or magnetically in place while allowing electronics package 205 to be rotated about central axial axis 225 relative to acoustic package 210 and soft ear interface 215. This rotation of electronics package 205 relative to acoustic package 210 implements a rotary user interface. The mechanical/magnetic connection facilitates rotational detents (e.g., 8, 16, 32) that provide a force feedback as the user rotates electronic package 205 with their fingers. Electrical trace rings 230 disposed circumferentially around post 220 provide electrical contacts for power and data signals communicated between electronics package 205 and acoustic package 210. In other embodiments, post 220 may be eliminated in favor of using flat circular disks to interface between electronics package 205 and acoustic package 210.

Soft ear interface 215 is fabricated of a flexible material (e.g., silicon, flexible polymers, etc.) and has a shape to insert into a concha and ear canal of the user to mechanically hold ear-mountable listening device 100 in place (e.g., via friction or elastic force fit). Soft ear interface 215 may be a custom molded piece (or fabricated in a limited number of sizes) to accommodate different concha and ear canal sizes/shapes. Soft ear interface 215 provides a comfort fit while mechanically sealing the ear to dampen or attenuate direct propagation of external sounds into the ear canal. Soft ear interface 215 includes an internal cavity shaped to receive a proximal end of acoustic package 210 and securely holds acoustic package 210 therein, aligning ports 235 with in-ear aperture 240. A flexible flange 245 seals soft ear interface 215 to the backside of electronics package 205 encasing acoustic package 210 and keeping moisture away from acoustic package 210. Though not illustrated, in some embodiments, the distal end of acoustic package 210 may include a barbed ridge encircling ports 235 that friction fit or "click" into a mating indent feature within soft ear interface 215.

FIG. 1C illustrates how ear-mountable listening device 100 is held by, mounted to, or otherwise disposed in the user's ear. As illustrated, soft ear interface 215 is shaped to hold ear-mountable listening device 100 with central axial axis 225 substantially falling within (e.g., within 20 degrees) a coronal plane 105. As is discussed in greater detail below, an array of microphones extends around central axial axis 225 in a ring pattern that substantially falls within a sagittal plane 106 of the user. When ear-mountable listening device 100 is worn, electronics package 205 is held close to the pinna of the ear and aligned along, close to, or within the pinna plane. Holding electronics package 205 close into the pinna not only provides a desirable industrial design (relative to further out protrusions), but may also has less impact on the user's HRTF or more readily lend itself to a definable/characterizable impact on the user's HRTF, for which offsetting calibration may be achieved. As mentioned, the central hole in the main circuit board along with cylindrical port 207 facilitate this close in mounting of electronics package 205 despite mounting speakers 212 directly in front of the ear canal in between electronics package 205 and the ear canal along central axial axis 225.

Figure 3:
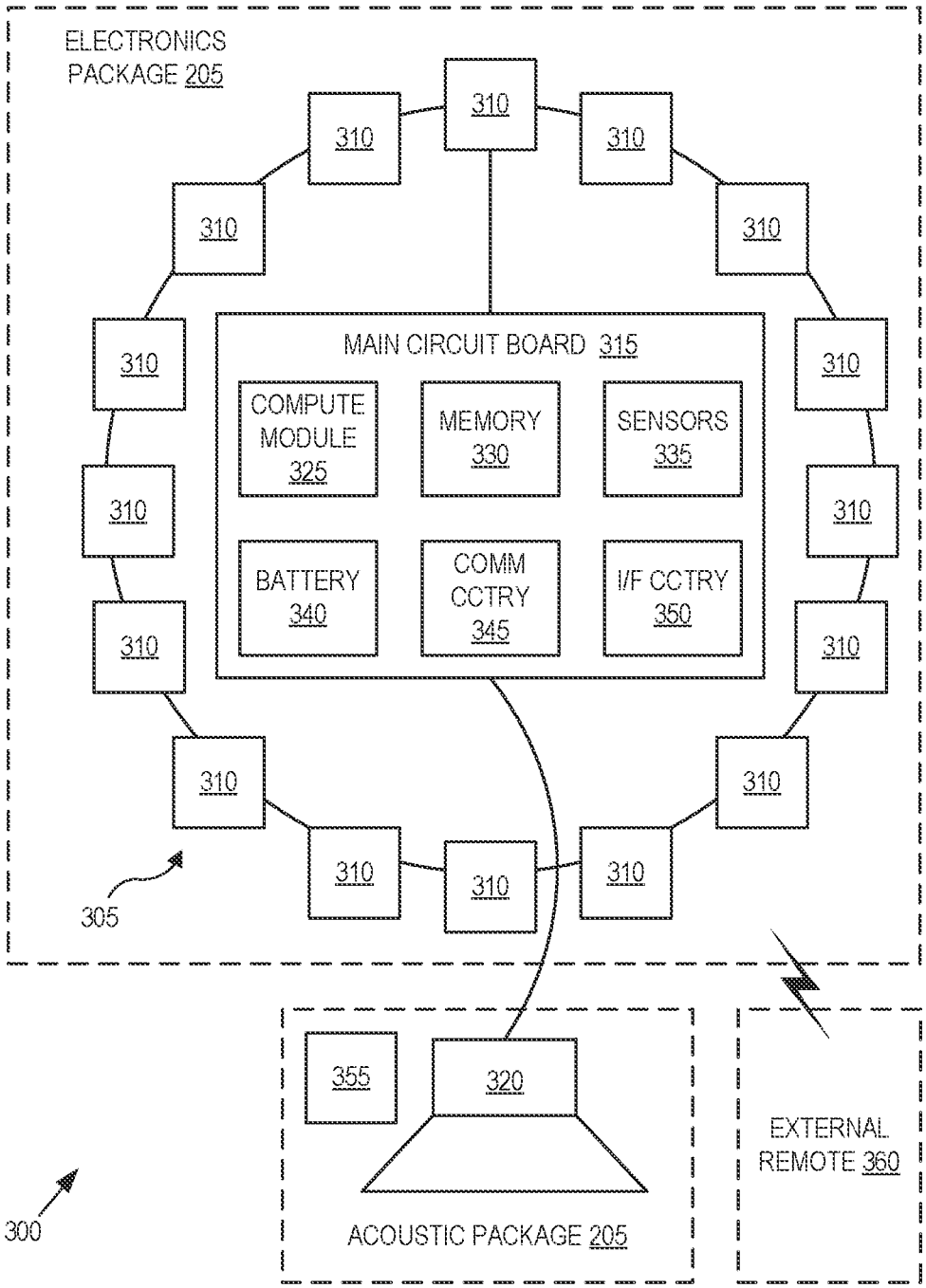
FIG. 3 is a block diagram illustrating select functional components of the ear-mountable listening device, in accordance with an embodiment of the disclosure.

FIG. 3 is a block diagram illustrating select functional components 300 of ear-mountable listening device 100, in accordance with an embodiment of the disclosure. The illustrated embodiment of components 300 includes an adaptive phased array 305 of microphones 310 and a main circuit board 315 disposed within electronics package 205 while speaker(s) 320 are disposed within acoustic package 205. Main circuit board 315 includes various electronics disposed thereon including a compute module 325, memory 330, sensors 335, battery 340, communication circuitry 345, and interface circuitry 350. The illustrated embodiment also includes an internal microphone 355 disposed within acoustic package 205. An external remote 360 (e.g., handheld device, smart ring, etc.) is wirelessly coupled to ear-mountable listening device 100 (or binaural listening system 101) via communication circuitry 345. Although not illustrated, acoustic package 205 may also include some electronics for digital signal processing (DSP), such as a printed circuit board (PCB) containing a signal decoder and DSP processor for digital-to-analog (DAC) conversion and EQ processing, a bi-amped crossover, and various auto-noise cancellation and occlusion processing logic.

In one embodiment, microphones 310 are arranged in a ring pattern (e.g., circular array, elliptical array, etc.) around a perimeter of main circuit board 315. Main circuit board 315 itself may have a flat disk shape, and in some embodiments, is an annular disk with a central hole. There are a number of advantages to mounting multiple microphones 310 about a flat disk on the side of the user's head for an ear-mountable listening device. However, one limitation of such an arrangement is that the flat disk restricts what can be done with the space occupied by the disk. This becomes a significant limitation if it is necessary or desirable to orientate a loudspeaker, such as speaker 320 (or speakers 212), on axis with the auditory canal as this may push the flat disk (and thus electronics package 205) quite proud of the ears. In the case of a binaural listening system, protrusion of electronics package 205 significantly out past the pinna plane may even distort the natural time of arrival of the sounds to each ear and further distort spatial perception and the user's HRTF potentially beyond a calibratable correction. Fashioning the disk as an annulus (or donut) enables protrusion of the driver of speaker 320 (or speakers 212) through main circuit board 315 and thus a more direct orientation/alignment of speaker 320 with the entrance of the auditory canal.

Microphones 310 may each be disposed on their own individual microphone substrates. The microphone port of each microphone 310 may be spaced in substantially equal angular increments about central axial axis 225. In FIG. 3, sixteen microphones 310 are equally spaced; however, in other embodiments, more or less microphones may be distributed (evenly or unevenly) in the ring pattern about central axial axis 225.

Compute module 325 may include a programmable microcontroller that executes software/firmware logic stored in memory 330, hardware logic (e.g., application specific integrated circuit, field programmable gate array, etc.), or a combination of both. Although FIG. 3 illustrates compute module 325 as a single centralized resource, it should be appreciated that compute module 325 may represent multiple compute resources disposed across multiple hardware elements on main circuit board 315 and which interoperate to collectively orchestrate the operation of the other functional components. For example, compute module 325 may execute logic to turn ear-mountable listening device 100 on/off, monitor a charge status of battery 340 (e.g., lithium ion battery, etc.), pair and unpair wireless connections, switch between multiple audio sources, execute play, pause, skip, and volume adjustment commands received from interface circuitry 350, commence multi-way communication sessions (e.g., initiate a phone call via a wirelessly coupled phone), control volume of the real-world environment passed to speaker 320 (e.g., modulate noise cancellation and perceptual transparency), enable/disable speech enhancement modes, enable/disable smart volume modes (e.g., adjusting max volume threshold and noise floor), or otherwise. In one embodiment, compute module 325 includes a trained neural network.

Sensors 335 may include a variety of sensors such as an inertial measurement unit (IMU) including one or more of a three axis accelerometer, a magnetometer (e.g., compass), or a gyroscope. Communication interface 345 may include one or more wireless transceivers including near-field magnetic induction (NFMI) communication circuitry and antenna, ultra-wideband (UWB) transceivers, a WiFi transceiver, a radio frequency identification (RFID) backscatter tag, a Bluetooth antenna, or otherwise. Interface circuitry 350 may include a capacitive touch sensor disposed across the distal surface of electronics package 205 to support touch commands and gestures on the outer portion of the puck-like surface, as well as a rotary user interface (e.g., rotary encoder) to support rotary commands by rotating the puck-like surface of electronics package 205. A mechanical push button interface operated by pushing on electronics package 205 may also be implemented.

Figure 4:
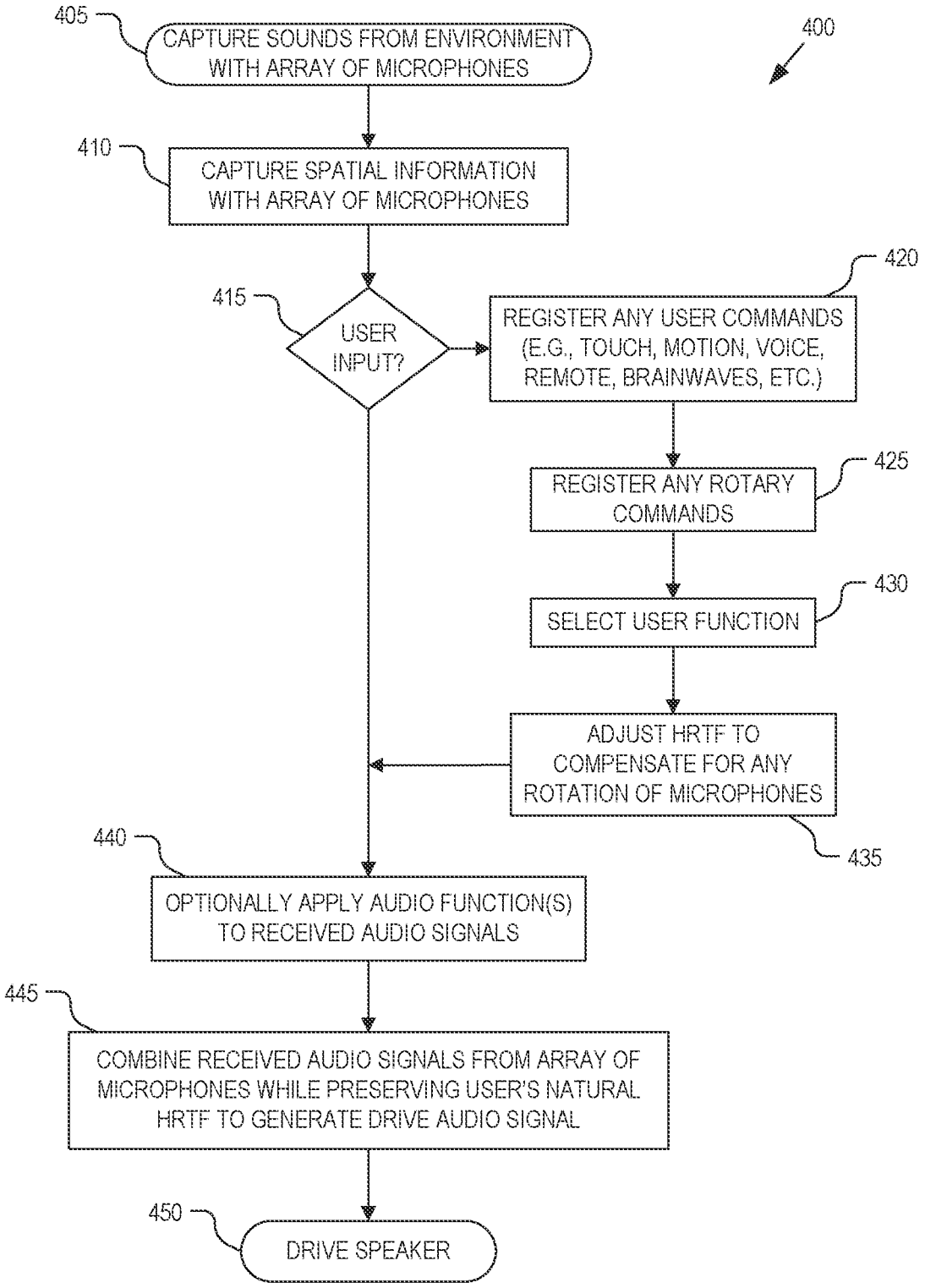
FIG. 4 is a flow chart illustrating operation of the ear-mountable listening device, in accordance with an embodiment of the disclosure.

FIG. 4 is a flow chart illustrating a process 400 for operation of ear-mountable listening device 100, in accordance with an embodiment of the disclosure. The order in which some or all of the process blocks appear in process 400 should not be deemed limiting. Rather, one of ordinary skill in the art having the benefit of the present disclosure will understand that some of the process blocks may be executed in a variety of orders not illustrated, or even in parallel.

In a process block 405, sounds from the external environment incident upon array 305 are captured with microphones 310. Due to the plurality of microphones 310 along with their physical separation, the spaciousness or spatial information of the sounds is also captured (process block 410). By organizing microphones 310 into a ring pattern (e.g., circular array) with equal angular increments about central axial axis 225, the spatial separation of microphones 310 is maximized for a given area thereby improving the spatial information that can be extracted by compute module 325 from array 305. In the case of binaural listening system 101 operating with linked microphone arrays, additional spatial information can be extracted from the pair of ear devices 100 related to interaural differences. For example, interaural time differences of sounds incidents on each of the user's ears can be measured to extract spatial information. Level (or volume) difference cues can be analyzed between the user's ears. Spectral shaping differences between the user's ears can also be analyzed. This interaural spatial information is in addition to the intra-aural time and spectral differences that can be measured across a single microphone array 305. All of this spatial information can be captured by adaptive phased arrays 305 of the binaural pair and extracted from the incident sounds emanating from the user's environment.

Spatial information includes the diversity of amplitudes and phase delays across the acoustical frequency spectrum of the sounds captured by each microphone 310 along with the respective positions of each microphone. In some embodiments, the number of microphones 310 along with their physical separation (both within a single ear-mountable listening device and across a binaural pair of ear-mountable listening devices worn together) can capture spatial information with sufficient spatial diversity to localize the origination of the sounds within the user's environment. Compute module 325 can use this spatial information to recreate an audio signal for driving speaker(s) 320 that preserves the spaciousness of the original sounds (in the form of phase delays and amplitudes applied across the audible spectral range). In one embodiment, compute module 325 is a neural network trained to leverage the spatial information and reassert, or otherwise preserve, the user's natural HRTF so that the user's brain does not need to relearn a new HRTF when wearing ear-mountable listening device 100. While the human mind is capable of relearning new HRTFs within limits, such training can take over a week of uninterrupted learning. Since a user of ear-mountable listening device 100 (or binaural listening system 101) would be expected to wear the device some days and not others, or for only part of a day, preserving/reasserting the user's natural HRTF may help avoid disorientating the user and reduce the barrier to adoption of a new technology.

In a decision block 415, if any user inputs are sensed, process 400 continues to process blocks 420 and 425 where any user commands are registered. In process block 420, user commands may be touch commands (e.g., via a capacitive touch sensor or mechanical button disposed in electronics package 205), motion commands (e.g., head motions or nodes sensed via a motion sensor in electronics package 205), voice commands (e.g., natural language or vocal noises sensed via internal microphone 355 or adaptive phased array 305), a remote command issued via external remote 360, or brainwaves sensed via brainwave sensors/electrodes disposed in or on ear devices 100 (process block 420). Touch commands may even be received as touch gestures on the distal surface of electronics package 205. User commands may also include rotary commands received via rotating electronics package 205 (process block 425). The rotary commands may be determined using the IMU to sense each rotational detent. Alternatively (or additionally), adaptive phased array 305 may be used to sense the rotational orientation of electronics package 205 and thus implement the rotary encoder. For example, the user's own voice originates from a known fixed location relative to the user's ears. As such, the array of microphones 310 may be used to perform acoustical beamforming to localize the user's voice and determine the absolute rotational orientation of array 305. Since the user may not be talking when operating the rotary interface, the acoustical beamforming and localization may be a periodic calibration while the IMU or other rotary encoders are used for instantaneous registration of rotary motion. Upon registering a user command, compute module 325 selects the appropriate function, such as volume adjust, skip/pause song, accept or end phone call, enter enhanced voice mode, enter active noise cancellation mode, enter acoustical beam steering mode, or otherwise (process block 430).

Once the user rotates electronics package 205, the angular position of each microphone 310 in adaptive phased array 305 is changed. This requires rotational compensation or transformation of the HRTF to maintain meaningful state information of the spatial information captured by adaptive phased array 305. Accordingly, in process block 435, compute module 325 applies the appropriate rotational transformation matrix to compensate for the new positions of each microphone 310. Again, in one embodiment, input from IMU may be used to apply an instantaneous transformation and acoustical beamforming techniques may be used to apply a periodic recalibration/validation when the user talks. In the case of using acoustical beamforming to determine the absolute angular position of adaptive phased array 305, the maximum number of detents in the rotary interface is related to the number of microphones 310 in adaptive phased array 305 to enable angular position disambiguation for each of the detents using acoustical beamforming.

In a process block 440, the audio data and/or spatial information captured by adaptive phased array 305 may be used by compute module 325 to apply various audio processing functions (or implement other user functions selected in process block 430). For example, the user may rotate electronics package 205 to designate an angular direction for acoustical beamforming. This angular direction may be selected relative to the user's front to position a null 125 (for selectively muting an unwanted sound) or a maxima lobe 130 (for selectively amplifying a desired sound). Other audio functions may include filtering spectral components to enhance a conversation, adjusting the amount of active noise cancellation, adjusting perceptual transparency, etc.

In a process block 445, one or more of the audio signals captured by adaptive phased array 305 are intelligently combined to generate an audio signal for driving speaker(s) 320 (process block 450). The audio signals output from adaptive phased array 305 may be combined and digitally processed to implement the various processing functions. For example, compute module 325 may analyze the audio signals output from each microphone 310 to identify one or more "lucky microphones." Lucky microphones are those microphones that due to their physical position happen to acquire an audio signal with less noise than the others (e.g., sheltered from wind noise). If a lucky microphone is identified, then the audio signal output from that microphone 310 may be more heavily weighted or otherwise favored for generating the audio signal that drives speaker 320. The data extracted from the other less lucky microphones 310 may still be analyzed and used for other processing functions, such as localization.

In one embodiment, the processing performed by compute module 325 may preserve the user's natural HRTF thereby preserving their ability to localize the physical direction from where the original environmental sounds originated. In other words, the user will be able to identify the directional source of sounds originating in their environment despite the fact that the user is hearing a regenerated version of those sounds emitted from speaker 320. The sounds emitted from speaker 320 recreate the spaciousness of the original environmental sounds in a way that the user's mind is able to faithfully localize the sounds in their environment. In one embodiment, reassertion of the natural HRTF is a calibrated feature implemented using machine learning techniques and trained neural networks. In other embodiments, reassertion of the natural HRTF is implemented via traditional signal processing techniques and some algorithmically driven analysis of the listener's original HRTF.

Figure 5A:
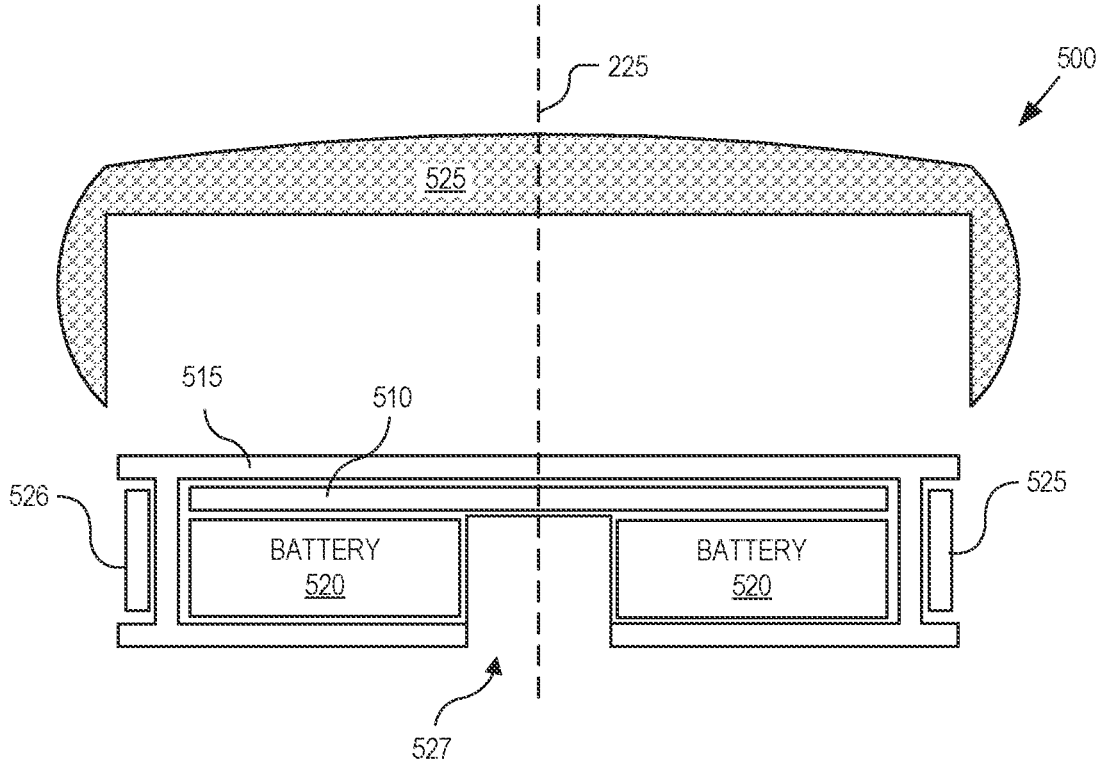
FIGS. 5A & 5B illustrate an electronics package of the ear-mountable listening device including an array of microphones disposed in a ring pattern around a main circuit board, in accordance with an embodiment of the disclosure.
Figure 5B:
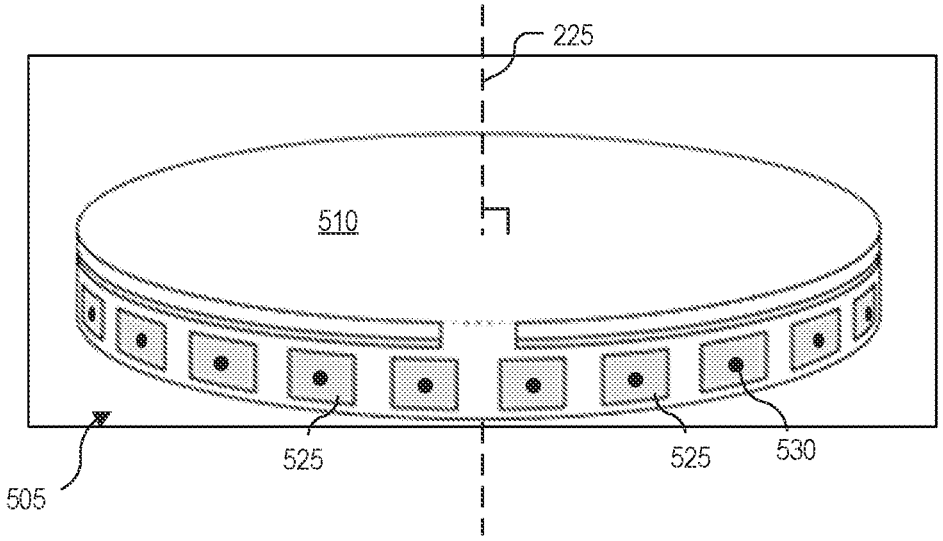

FIGS. 5A & 5B illustrate an electronics package 500, in accordance with an embodiment of the disclosure. Electronics package 500 represents an example internal physical structure implementation of electronics package 205 illustrated in FIG. 2. FIG. 5A is a cross-sectional illustration of electronics package 500 while FIG. 5B is a perspective view illustration of the same excluding cover 525. The illustrated embodiment of electronics package 500 includes an array 505 of microphones, a main circuit board 510, a housing or frame 515, a cover 525, and a rotary port 527. Each microphone within array 505 is disposed on an individual microphone substrate 526 and includes a microphone port 530.

FIGS. 5A & 5B illustrate how array 505 extends around central axial axis 225. Additionally, in the illustrated embodiment, array 505 extends around a perimeter of main circuit board 510. Although not illustrated, main circuit board 510 includes electronics disposed thereon, such as compute module 325, memory 330, sensors 335, communication circuitry 345, and interface circuitry 350. Main circuit board 510 is illustrated as a solid disc having a circular shape; however, in other embodiments, main circuit board 510 may be an annular disk with a central hole through which post 220 extends to accommodate protrusion of acoustic drivers aligned with the ear canal entrance. In the illustrated embodiment, the surface normal of main circuit board 510 is parallel to and aligned with central axial axis 225 about which the ring pattern of array 505 extends.

The electronics may be disposed on one side, or both sides, of main circuit board 510 to maximize the available real estate. Housing 515 provides a rigid mechanical frame to which the other components are attached. Cover 525 slides over the top of housing 515 to enclose and protect the internal components. In one embodiment, a capacitive touch sensor is disposed on housing 515 beneath cover 525 and coupled to the electronics on main circuit board 510. Cover 525 may be implemented as a mesh material that permits acoustical waves to pass unimpeded and is made of a material that is compatible with capacitive touch sensors (e.g., non-conductive dielectric material).

As illustrated in FIGS. 5A & 5B, array 505 encircles a perimeter of main circuit board 510 with each microphone disposed on an individual microphone substrate 526. In the illustrated embodiment, microphone ports 530 are spaced in substantially equal angular increments about central axial axis 225. Of course, other nonequal spacings may also be implemented. The individual microphone substrate 526 are planer substrates oriented vertical (in the figure) or perpendicular to main circuit board 510 and parallel with central axial axis 225. However, in other embodiments, the individual microphone substrates may be tilted relative to central axial axis 225 and the normal of main circuit board 510. Of course, the microphone array may assume other positions and/or orientations within electronics package 205.

FIG. 5A illustrates an embodiment where main circuit board 510 is a solid disc without a central hole. In that embodiment, post 220 of acoustic package 210 extends into rotary port 527, but does not extend through main circuit board 510. The inside surface of rotary port 527 may include magnets for holding acoustic package 210 therein and conductive contacts for making electrical connections to electrical trace rings 230. Of course, in other embodiments, main circuit board 510 may be an annulus with a center hole 605 allowing post 230 to extend further into electronics package 205 enabling thinner profile designs. A center hole in main circuit board 510 provides additional room or depth for larger acoustic drivers within post 220 of acoustic package 205 to be aligned directly in front of the entrance to the user's ear canal.

Figure 6A:
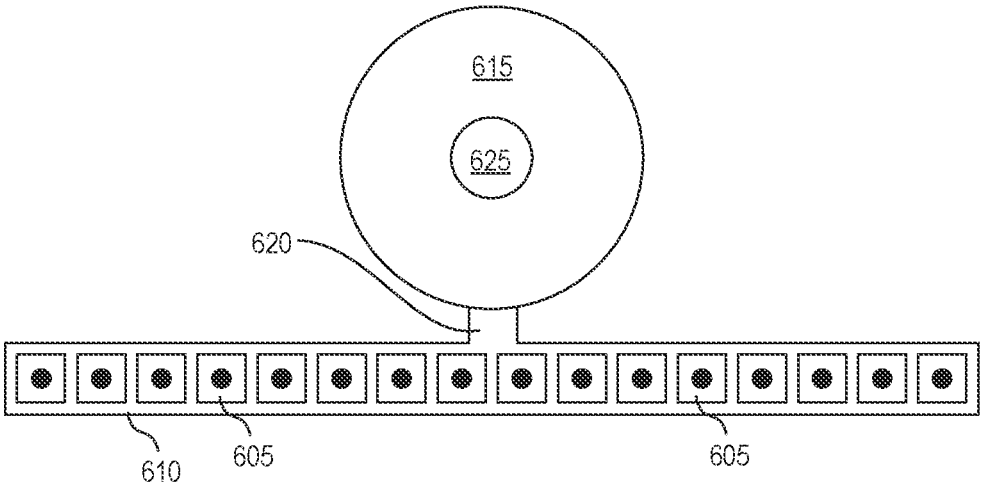
FIGS. 6A and 6B illustrate individual microphone substrates interlinked into the ring pattern via a flexible circumferential ribbon that encircles the main circuit board, in accordance with an embodiment of the disclosure.
Figure 6B:
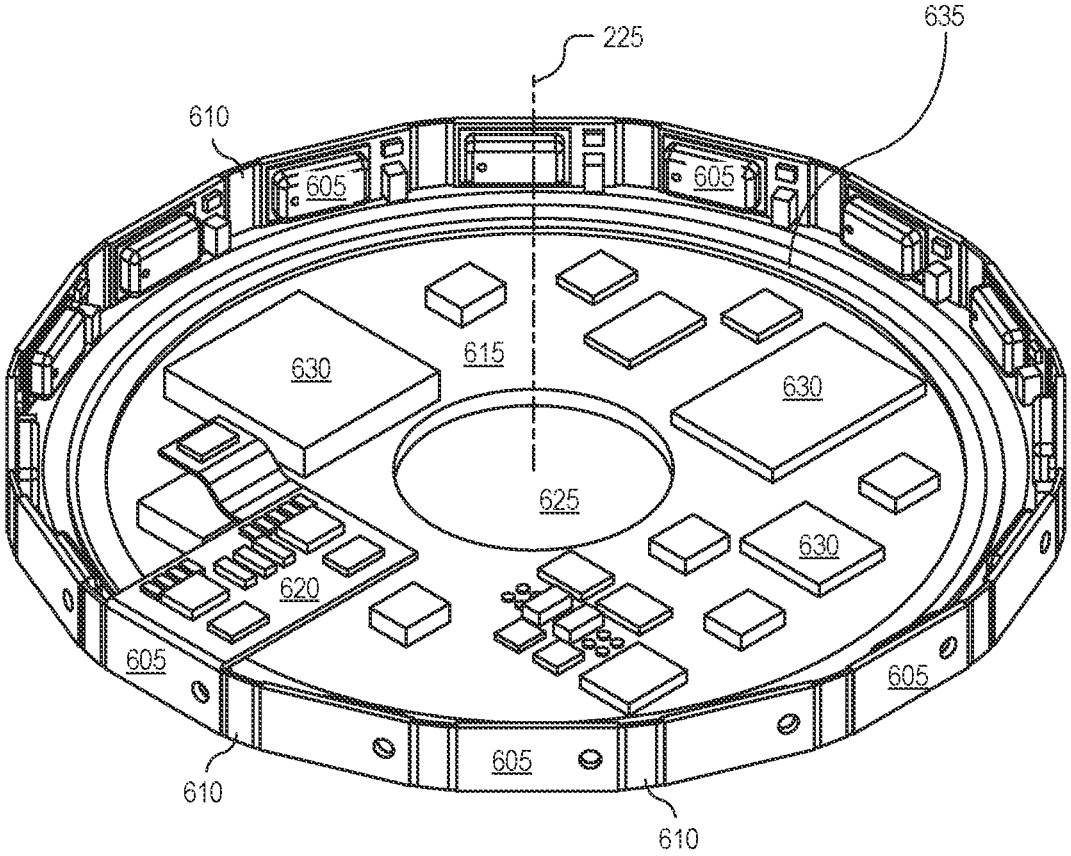

FIGS. 6A and 6B illustrate individual microphone substrates 605 interlinked into a ring pattern via a flexible circumferential ribbon 610 that encircles a main circuit board 615, in accordance with an embodiment of the disclosure. FIGS. 6A and 6B illustrate one possible implementation of some of the internal components of electronics package 205 or 500. As illustrated in FIG. 6A, individual microphone substrates 605 may be mounted onto flexible circumferential ribbon 610 while rolled out flat. A connection tab 620 provides the data and power connections to the electronics on main circuit board 615. After assembling and mounting individual microphone substrates 605 onto ribbon 610, it is flexed into its circumferential position extending around main circuit board 615, as illustrated in FIG. 6B. As an example, main circuit board 615 is illustrated as an annulus with a center hole 625 to accept post 220 (or component protrusions therefrom). Furthermore, the individual electronic chips 630 (only a portion are labeled) and perimeter ring antenna 635 for near field communications between a pair of ear devices 100 are illustrated merely as demonstrative implementations. Of course, other mounting configurations for microphones 605 and microphone substrates 610 may be implemented.

Figure 7:
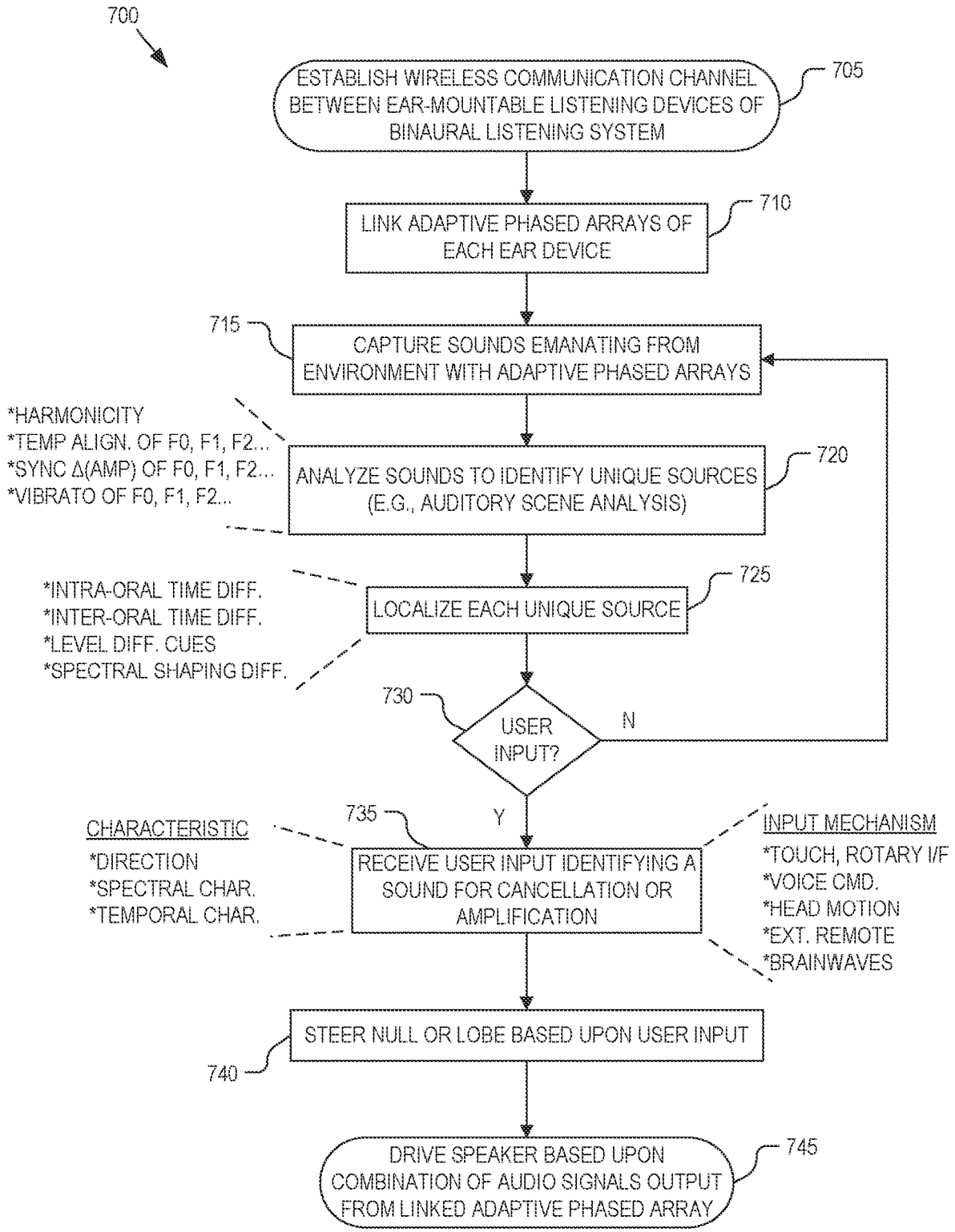
FIG. 7 is a flow chart illustrating a process for linking adaptive phased arrays of a binaural listening system to implement acoustical beamforming, in according with an embodiment of the disclosure.

FIG. 7 is a flow chart illustrating a process for linking adaptive phased arrays of binaural listening system 101 to implement acoustical beamforming, in according with an embodiment of the disclosure. The order in which some or all of the process blocks appear in process 700 should not be deemed limiting. Rather, one of ordinary skill in the art having the benefit of the present disclosure will understand that some of the process blocks may be executed in a variety of orders not illustrated, or even in parallel.

In a process block 705, wireless communication channel 110 is established between a pair of ear-mountable listening devices 100. The wireless communication channel 110 may be a high bandwidth NFMI channel established by communication circuitry 345 over antenna 635. Once ear devices 100 are paired, their adaptive phased arrays 305 may be linked to form a larger linked adaptive phased array. The linked adaptive phased array not only includes twice as many individual microphones 310, but also provides greater physical separation between the microphones and thus capable of beamforming at lower acoustic frequencies.

In a process block 715, sounds emanating from the user's environment are captured with the linked adaptive phased array and analyzed by compute module 325 (process block 720). This analysis may include an auditory scene analysis based upon the audio signals output from each microphone 310. The auditory scene analysis serves to identify unique sources 135 and 140 in the environment. Auditory scene analysis may include identifying unique fundamental frequencies of different human voices to identify N unique humans talking in a room. A number of factors may be considered to determine whether a given spectral component represents a fundamental frequency of a unique human voice. A first factor includes harmonicity. A human voice is composed of a fundamental frequency f0, along with harmonics f1, f2, f3 . . . thereof. The presences of a fundamental frequency along with harmonics is an indication of a unique source. If the fundamental frequency along with its harmonics are temporally aligned (i.e., starting and stop in synchronicity), this is yet another indication of a unique source. Synchronous changes in amplitude of a fundamental frequency along with its harmonics is another indication of a unique source. The presence of vibrato where a fundamental frequency along with its harmonics are frequency modulated in unison is yet another confirming factor in favor of a unique source. Harmonicity, temporal alignment, synchronous amplitude modulation, and vibrator may all be considered by compute module 325 to identify unique sources of sound, in particular, unique human voices.

With N unique sources identified as a result of the auditory scene analysis, compute module 325 may proceed to localize each of these N unique sources (process block 725). A number of factors may be considered to localize a unique source including: intra-aural time differences of the sounds across a given adaptive phased array 310, interaural time differences of the sounds across the linked adaptive phased arrays (i.e., between the different ear devices), level difference cues between the ear devices (i.e., is a given sound louder at one ear than the other), and spectral shaping differences. Spectral shaping differences are based upon the same or similar principles as the HRTF.

With unique sources identified and localized, compute module 325 can adapt or adjust the weights and phase delays applied to the audio signals output from the linked adaptive phased arrays of microphones to generate an appropriate acoustical gain pattern 120. This determination may be automatic based upon what a machine learning algorithm running on compute module 325 thinks are the user's desires (i.e., based upon implicit user commands), and/or in response to an explicit user command. Whether implicit or explicit, user inputs (decision block 730 and process block 735) are considered.

User inputs may be acquired from one or more input mechanism including: a touch sensor, the rotary interface, a microphone, a motion sensor, external remote 360, or brainwave sensors. The touch sensor may register finger taps or other gestures. The microphone may be internal microphone 355 or microphone array 305 to register vocal commands. These vocal commands may be natural language commands or simple sounds (e.g., ticking or popping sounds made with the tongue). The motion sensor may include an IMU to register head nodes in particular directions. The various input mechanisms for the user commands may convey directional instructions, such as mute noise originating from a certain direction or amplify sounds coming from another direction. Alternatively (or additionally), the user commands may convey spectral characteristics of the sounds that the user wishes to mute or amplify. For example, the user may convey a desire to reduce or mute higher frequency sources (e.g., mute children voices), while amplifying lower frequency sources (e.g., amplify adult voices). In yet another scenario, the user commands may convey temporal characteristics of the sounds that the user wishes to mute or amplify. In such a scenario, the user may wish to mute rhythmic sounds (e.g., music) while amplifying a voice. Of course, combinations of these user commands may be conveyed in process block 735 using the various user interfaces and sensors described above.

In process block 740, compute module 325 generates an acoustical gain pattern 120 with a suitable number and position of nulls 125 and/or lobes 130 via appropriate application of weights and phase delays to the audio signals output from adaptive phased arrays 305, and steers nulls 125 to coincide with localized unique sources the user wishes to mute while steering lobes 130 to coincide with the localized unique sources the user wishes to hear (process block 740). Finally, in process block 745, speaker 320 is driven based upon the dynamically adjusted combination of audio signals output from the linked adaptive phased array.

The processes explained above are described in terms of computer software and hardware. The techniques described may constitute machine-executable instructions embodied within a tangible or non-transitory machine (e.g., computer) readable storage medium, that when executed by a machine will cause the machine to perform the operations described. Additionally, the processes may be embodied within hardware, such as an application specific integrated circuit ("ASIC") or otherwise.

A tangible machine-readable storage medium includes any mechanism that provides (i.e., stores) information in a non-transitory form accessible by a machine (e.g., a computer, network device, personal digital assistant, manufacturing tool, any device with a set of one or more processors, etc.). For example, a machine-readable storage medium includes recordable/non-recordable media (e.g., read only memory (ROM), random access memory (RAM), magnetic disk storage media, optical storage media, flash memory devices, etc.).

The above description of illustrated embodiments of the invention, including what is described in the Abstract, is not intended to be exhaustive or to limit the invention to the precise forms disclosed. While specific embodiments of, and examples for, the invention are described herein for illustrative purposes, various modifications are possible within the scope of the invention, as those skilled in the relevant art will recognize.

These modifications can be made to the invention in light of the above detailed description. The terms used in the following claims should not be construed to limit the invention to the specific embodiments disclosed in the specification. Rather, the scope of the invention is to be determined entirely by the following claims, which are to be construed in accordance with established doctrines of claim interpretation.

What is claimed is:

1. An ear-mountable listening device, comprising:

an adaptive phased array of microphones physically arranged into a ring pattern to capture sounds emanating from an environment, wherein each of the microphones of the adaptive phased array is configured to output one of a plurality of first audio signals that is representative of the sounds captured by a respective one of the microphones;

a speaker arranged to emit audio into an ear in response to a second audio signal; and electronics coupled to the adaptive phased array and the speaker, the electronics including logic that when executed by the electronics causes the ear-mountable listening device to perform operations comprising:

receiving a user input identifying a first sound of the sounds emanating from the environment for cancelling or amplifying;

steering a null or a lobe of the adaptive phased array based upon the user input; and generating the second audio signal that drives the speaker based upon one or more of the first audio signals.

2. The ear-mountable listening device of claim 1, wherein the ring pattern comprises a circular pattern.

3. The ear-mountable listening device of claim 2, wherein the electronics are disposed on a circuit board having a circular perimeter shape and wherein the microphones encircle the circuit board in substantially equal angular increments.

4. The ear-mountable listening device of claim 1, wherein the ring pattern is arranged within the ear-mountable listening device to extend around a central axial axis that substantially falls within a coronal plane of a user when the ear-mountable listening device is worn in the ear of the user.

5. The ear-mountable listening device of claim 1, wherein receiving the user input identifying the first sound for cancelling or amplifying comprises:

receiving the user input as an indication of a direction associated with where the first sound is emanating relative to a user of the ear-mountable listening device.

6. The ear-mountable listening device of claim 1, wherein receiving the user input identifying the first sound for cancelling or amplifying comprises:

receiving the user input as an indication of a spectral or temporal characteristic associated with the first sound.

7. The ear-mountable listening device of claim 1, wherein the electronics include a motion sensor and the user input identifying the first sound is sensed as a head motion via the motion sensor.

8. The ear-mountable listening device of claim 1, wherein the user input identifying the first sound is sensed as a voice command from a user of the ear-mountable listening device.

9. The ear-mountable listening device of claim 8, further comprising:

an internal microphone coupled to the electronics and oriented within the ear-mountable listening device to focus on user sounds emanating from an ear canal when the ear-mountable listening device is worn, wherein the voice command is received via the internal microphone.

10. The ear-mountable listening device of claim 1, wherein the user input identifying the first sound is received via an external remote or via a brainwave sensor disposed in or on the ear-mountable listening device and positioned to sense brainwaves of a user of the ear-mountable listening device.

11. The ear-mountable listening device of claim 1, wherein the ear-mountable listening device includes three modular components comprising:

an electronics package having a puck-like shape and including the adaptive phased array and the electronics disposed therein;

a soft ear interface fabricated of a flexible material and having a shape to at least partially insert into an ear canal of the ear; and an acoustic package including the speaker, the acoustic package shaped to at least partially insert into the soft ear interface and connect the soft ear interface to the electronics package.

12. The ear-mountable listening device of claim 11, wherein the electronics package includes a capacitive touch sensor and rotates relative to the acoustic package to provide a rotary user interface, wherein the user input identifying the first sound is received via one of, or a combination of, the capacitive touch sensor or the rotary user interface.

13. The ear-mountable listening device of claim 1, wherein the ear-mountable listening device further includes an antenna coupled to the electronics, wherein the ear-mountable listening device comprises a first ear device of a binaural listening system and the adaptive phased array comprises a first adaptive phased array, and wherein the electronics include further logic that when executed by the electronics causes the ear-mountable listening device to perform further operations comprising:

establishing a communication channel with a second ear device of the binaural listening system via the antenna; and linking the first adaptive phased array with a second adaptive phased array of the second ear device over the communication channel to form a linked adaptive phased array.

14. The ear-mountable listening device of claim 13, wherein the electronics include further logic that when executed by the electronics causes the ear-mountable listening device to perform further operations comprising:

analyzing the sounds emanating from the environment with the linked adaptive phased array to localize the sounds emanating from the environment.

15. The ear-mountable listening device of claim 14, wherein analyzing the sounds with the linked adaptive phased array to localize the sounds comprises localizing sounds having a fundamental frequency of an adult male human voice.

16. The ear-mountable listening device of claim 13, wherein the electronics include further logic that when executed by the electronics causes the ear-mountable listening device to perform further operations comprising:

performing an auditory scene analysis based upon the first audio signals to identify unique sources of the sounds emanating from the environment;

localizing each of the unique sources within the environment based upon one or more of:

intra-aural time differences of the sounds across the first adaptive phased array;

interaural time differences of the sounds across the first and second adaptive phased arrays; or level difference cues between the first and second adaptive phased arrays.

17. A binaural listening system, comprising:

a first ear-mountable listening device for wearing in a first ear of a user, the first ear-mountable listening device including a first adaptive phased array of microphones to capture sounds emanating from an environment; and a second ear-mountable listening device for wearing in a second ear of the user, the second ear-mountable listening device including:

a second adaptive phased array of microphones physically arranged into a ring pattern to capture the sounds;

a speaker arranged to emit audio into the second ear;

an antenna; and electronics coupled to the second adaptive phased array, the speaker, and the antenna, the electronics including logic that when executed by the electronics causes the binaural listening system to perform operations comprising:

establishing a wireless communication channel via the antenna between the first and second ear-mountable listening devices;

linking the first and second adaptive phased arrays over the wireless communication channel to form a linked adaptive phased array; and beamforming the linked adaptive phased array to provide spatially selective cancellation or amplification of one or more of the sounds emanating from the environment.

18. The ear-mountable listening device of claim 17, wherein the electronics include further logic that when executed by the electronics causes the binaural listening system to perform further operations comprising:

analyzing the sounds emanating from the environment with the linked adaptive phased array to localize the sounds within the environment.

19. The ear-mountable listening device of claim 18, wherein analyzing the sounds with the linked adaptive phased array to localize the sounds comprises localizing sounds having a fundamental frequency of an adult male human voice.

20. The ear-mountable listening device of claim 17, wherein the electronics include further logic that when executed by the electronics causes the binaural listening device to perform further operations comprising:

performing an auditory scene analysis with the first or second adaptive phased arrays to identify unique sources of the sounds emanating from the environment;

localizing each of the unique sources within the environment based upon one or more of:

intra-aural time differences of the sounds across the second adaptive phased array;

interaural time differences of the sounds across the first and second adaptive phased arrays; or level difference cues between the first and second adaptive phased arrays.

21. The ear-mountable listening device of claim 17, wherein the electronics are disposed on a circuit board within the second ear-mountable listening device, the circuit board has a circular perimeter shape, and the microphones of the second adaptive phased array encircle the circuit board in substantially equal angular increments.

* * * * *